United States Patent [19]

Dore, Jr. et al.

[11] Patent Number: 4,960,143

[45] Date of Patent: Oct. 2, 1990

[54] CONTAINMENT APPARATUS

[75] Inventors: Arthur M. Dore, Jr.; Robert M. Sutherland, both of Bay City, Mich.

[73] Assignee: Aerospace America, Inc., Bay City, Mich.

[21] Appl. No.: 155,579

[22] Filed: Feb. 12, 1988

[51] Int. Cl.[5] ..... B08B 3/02

[52] U.S. Cl. ..... 134/199; 134/200; 134/201; 312/1

[58] Field of Search ..... 134/201, 200, 199; 128/1 R; 312/1; 277/105, 34.3, 176, 212 F, 177, 217

[56] References Cited

U.S. PATENT DOCUMENTS

| | | | |
|---|---|---|---|
| 1,977,386 | 10/1934 | Holes | 312/1 X |
| 2,219,564 | 10/1940 | Reyniers | 312/1 |
| 2,459,812 | 1/1949 | Griffiths | 312/1 X |
| 3,491,720 | 1/1970 | Harrs | 312/1 X |
| 3,567,232 | 3/1971 | Rickerson | 277/148 |
| 3,907,389 | 9/1975 | Cox et al. | 312/1 |
| 4,318,547 | 3/1982 | Ericson | 277/207 A |
| 4,327,760 | 5/1982 | Lancaster | 312/1 |
| 4,373,547 | 2/1983 | Geis et al. | 312/1 X |
| 4,503,577 | 3/1985 | Fowler | 134/122 R X |
| 4,626,291 | 12/1986 | Natale | 312/1 X |
| 4,712,270 | 12/1987 | Palmer | 15/345 |
| 4,738,273 | 4/1988 | Giacometti | 134/122 R X |
| 4,780,927 | 11/1988 | Clayton | 15/347 X |
| 4,820,000 | 4/1989 | Jacobson | 15/345 |

FOREIGN PATENT DOCUMENTS

| | | | |
|---|---|---|---|
| 1188191 | 6/1985 | Canada | 312/1 |
| 1567270 | 5/1980 | United Kingdom | 312/1 |
| 2157822 | 10/1985 | United Kingdom | 312/1 |

OTHER PUBLICATIONS

PCT Application PCT/AU86/00065 Sep. 25, 1986, Hamlet 312/1.

*Primary Examiner*—Frankie L. Stinson

*Attorney, Agent, or Firm*—Learman & McCulloch

[57] ABSTRACT

A containment housing adapted to be supported on a pipe from which hazardous insulation is to be removed. The housing is composed of two sections pivoted for movement between open and closed positions and has openings at its opposite ends through which the pipe may extend. The joints between the pivoted sections and the pipe-accommodating openings are equipped with seals to prevent insulation particles from escaping the housing. One of the pipe-accommodating openings has an area larger than that of the other to enable the seal at the smaller area opening to engage the bare pipe, whereas the seal at the larger area opening engages the insulation. The housing has an outlet at its bottom through which insulation may pass to a disposable pouch.

16 Claims, 2 Drawing Sheets

CONTAINMENT APPARATUS

This invention relates to a containment housing apparatus adapted to be applied to an insulated structural member, such as a pipe, from which the insulation is to be removed in such manner as to avoid contamination of the adjacent area with particles of such insulation.

BACKGROUND OF THE INVENTION

There are many instances in which asbestos insulation applied to pipes must be removed so as to avoid the risk of contaminating the area in which such pipes are located. Contamination can occur as a result of deterioriation of the insulation or as a result of inadvertent physical damaging of the insulation, or both. Removal of such insulation must be undertaken in an extremely careful manner, not only to avoid contamination of the adjacent environment, but also to ensure protection for the workers engaged in removing such insulation.

Equipment for use in removing asbestos insulation from pipes has been proposed heretofore. For example, pipe-supported bags for such purpose are disclosed in British patent specification No. 1,567,270 and U.S. Pat. No. 4,626,291. Theoretically, such bags will perform satisfactorily, but in actual practice this is not always the case.

One of the disadvantages of bags of the kind disclosed in the publications referred to above is the difficulty in moving the bag longitudinally of the pipe as the insulation stripping progresses. Another disadvantage encountered with such bags is their inability to accommodate pipe supports, i.e., suspension straps or rods, by means of which a pipe is supported at an overhead level. A further disadvantage of such prior art bags is that the manner in which the bag is suspended from a pipe, coupled with the difficulty in moving the bag longitudinally of the pipe, subjects the bag to potential failure as a result of the weight of insulation contained in the bag as the latter is attempted to be moved along the pipe.

A further disadvantage of the prior art bags is that they are intended to be disposable following each use. For the protection of the worker, however, each bag is fitted with integral sleeves and/or gloves which are disposed of with the bag once the latter has been filled. This represents substantial expense.

SUMMARY OF THE INVENTION

Containment apparatus for use in stripping hazardous materials from structural elements such as pipes so as to protect workers and the adjacent environment comprises a housing having end walls provided with openings for the accommodation of a pipe. The housing has hinged walls which enable the housing to be applied to and removed from the pipe when desired. The bottom of the housing preferably is closed by spring biased doors which provide temporary support for insulation removed from the pipe, but which may be opened to enable such material to be discharged to a flexible, disposable, pouch or bag which is removably secured to the housing.

The openings at the ends of the compartment through which the pipe extends differ in size so that one of the openings is capable of fitting the stripped pipe fairly snugly, whereas the opening at the opposite end not only snugly accommodates the pipe, but also the insulation thereon, thereby permitting the container to be fitted to a pipe at any zone thereof and moved longitudinally of the pipe in successive stages as insulation is stripped from that portion of the pipe which is accommodated within the housing.

The housing has a transparent window through which a worker may observe the pipe and its insulation. The housing also has inlets for the accommodation of sleeves and gloves in which the worker's arms and hands may be fitted to facilitate stripping of the insulation from the pipe.

The disposable pouch in which stripped insulation is accommodated has no sleeves or gloves associated therewith, thereby enabling an inexpensive bag to be used.

THE DRAWINGS

Apparatus constructed in accordance with the preferred embodiment of the invention is disclosed in the following description and in the accompanying drawings, wherein.

DETAILED DESCRIPTION

Figure 1:
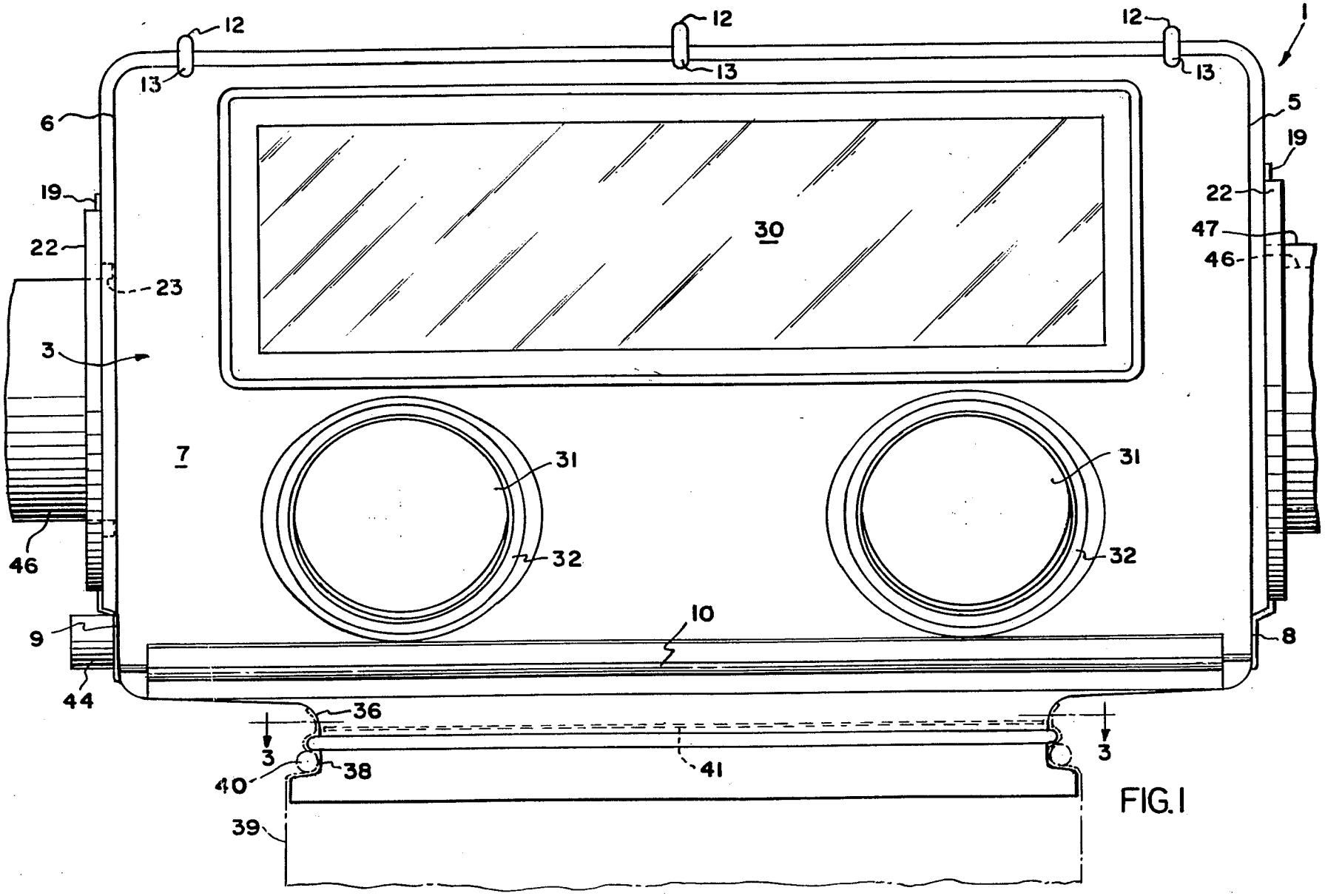
FIG. 1 is a side elevational view illustrating the apparatus applied to a pipe from which insulation is to be stripped.
Figure 2:
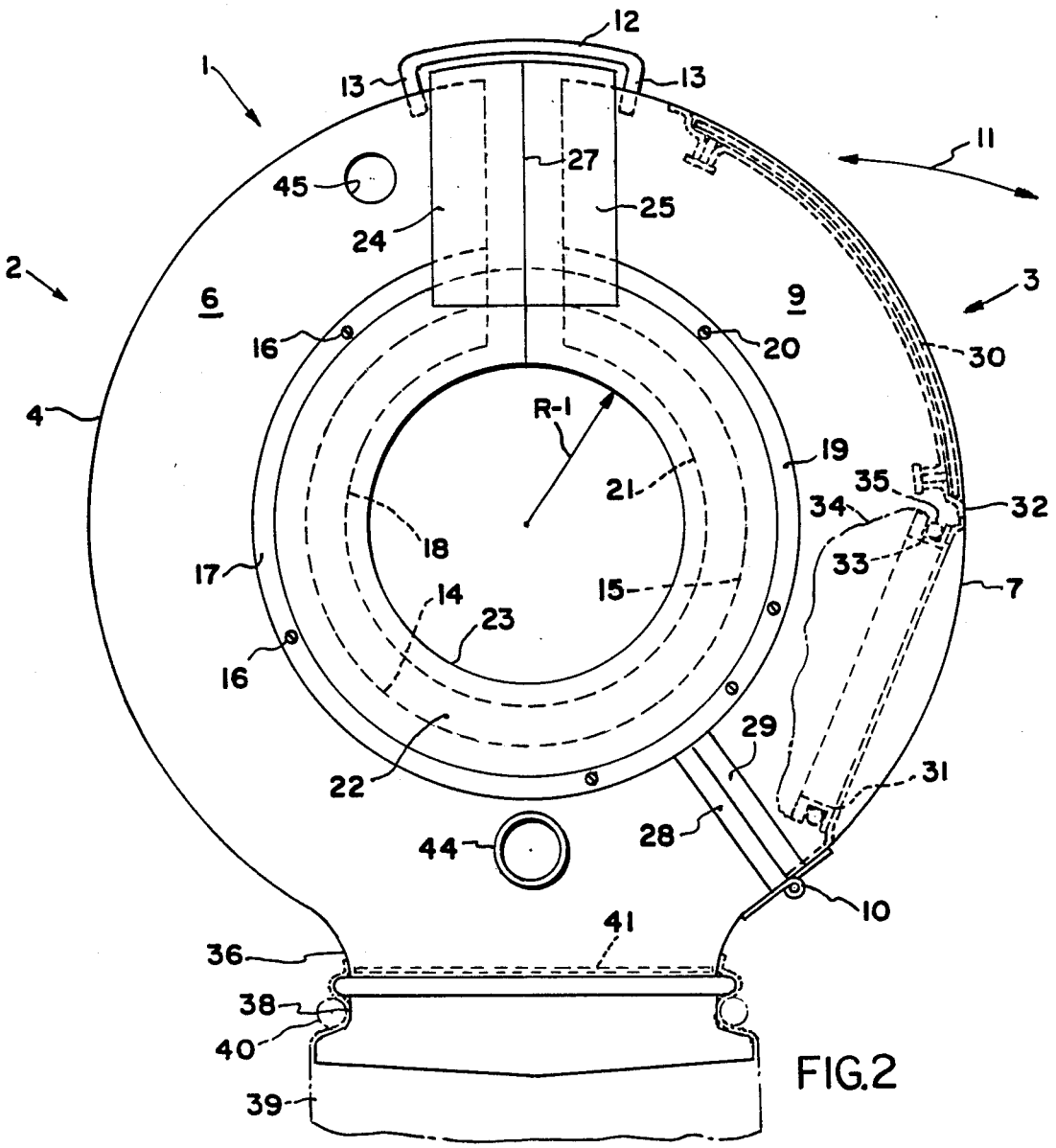
FIG. 2 is an end elevational view.
Figure 3:
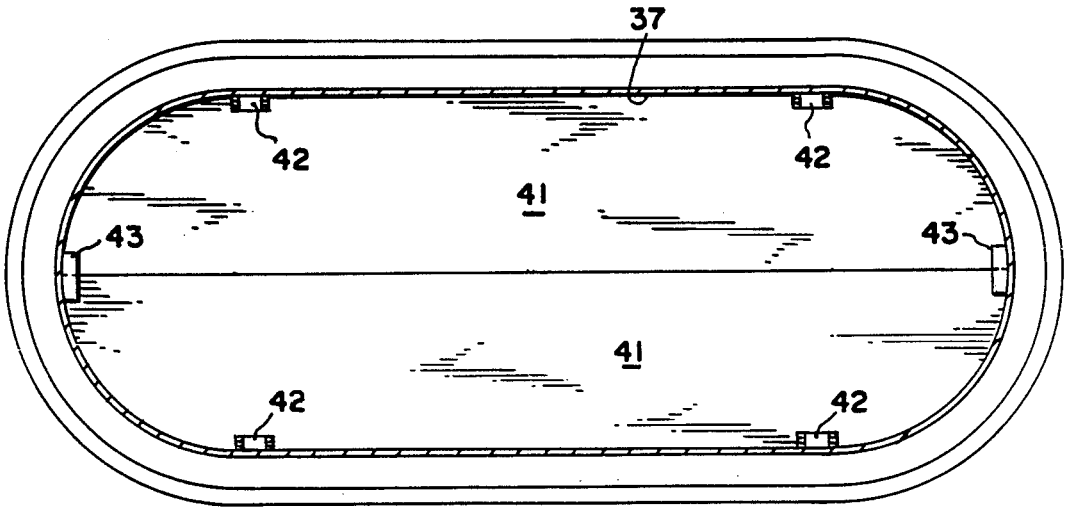
FIG. 3 is a sectional view taken on the line 3—3 of FIG. 1.

The preferred embodiment of the invention comprises a housing 1 having a main section 2 and a pivoted section 3. The main section 2 comprises a substantially semi-circular rear wall 4 terminating at its opposite ends in end walls 5 and 6 which substantially parallel one another and are spaced apart by the wall 4. The pivoted section 3 has a front wall 7 that is coextensive in length with the rear wall 4 and terminates at its opposite ends in end walls 8 and 9 which are coplanar with the end walls 5 and 6. The section 3 is pivoted to the section 2 by a longitudinally extending hinge 10, thereby enabling the section 3 to swing about the axis of the hinge 10 in the directions indicated by the double arrow 11 in FIG. 2. Suitable latching members 12 are provided and have legs 13 at their opposite ends for removable accommodation in openings formed in the walls 4 and 7 so as to retain the sections in their closed position as shown in FIGS. 1 and 2. The several walls of the housing are form stable and formed of suitable, rigid material such as fiberglass or stiff plastic. Preferably, the material is one which is capable of withstanding exposure to high temperatures, thereby enabling the apparatus to be used on hot pipes.

Each of the end walls 5 and 6 is provided with an arcuate edge 14 and each of the end walls 8 and 9 is provided with an arcuate edge 15. Each of the arcs of the respective confronting end walls is formed on the same center so that, when the sections 2 and 3 are in their closed position, the confronting arcuate surfaces 14 and 15 form a substantially circular opening.

Fixed to the end wall 6 by suitable screws 16 is an arcuate strap 17 of metal or other suitable material and which terminates in an arcuate, radially inner surface 18 that is concentric with the arcuate surface 14. The end wall 9 of the section 3 has a similar arcuate strap 19 secured thereto by screws 20 and which also terminates at its radially inner end in an arcuate, radially inner surface 21 formed on the same radius as the surface 18.

Adhesively or otherwise suitably secured to and in overlying relation with the straps 17 and 19 is an annular cuff or band 22 of resilient, yieldable, deformable sealing material such as foamed polyurethane having a skin or covering capable of resisting abrasion and tearing. The band 22 forms an opening 23 concentric with the surfaces 14, 15, 18, and 21 and having a radius R-1 which is less than the radius of the inner surfaces 18 and 21. Thus, the area of the opening 23 is less then that of the opening formed by the straps 17 and 19.

Similar cuffs or bands 24 and 25 of similar sealing material are adhered or otherwise suitably secured to the end walls 5, 6 and 8, 9 and to the rear and front walls 4 and 7 so as to provide an occlusion between the confronting edges of the front of the side walls and the rear and front walls. As is best shown in FIG. 2, the end walls and the rear and front walls do not abut one another at the upper end of the housing, but terminate short of one another. This provides a gap between the confronting edges of such walls which is filled by the sealing bands 24 and 25 which abut one another along a separable joint 27. Each cuff 22 has a radial slit therethrough which is in register with the adjacent portion of the joint 27.

The end walls also are provided with sealing cuffs or bands 28 and 29 similar to the bands 24 and 25 and which are located on the adjacent sides of the respective end walls so as to provide a seal along the joint between the respective end walls.

The end walls 5 and 8 of the housing are provided with arcuate straps 17, 19 and an annular seal 22 like the corresponding parts described earlier, but in the case of the members 17, 19, and 22 at the right-hand end of the housing, as viewed in FIG. 1, the annular width of the members 17 and 19 and the annular width of the band 22 are less than the annular widths of the corresponding members described earlier so that the pipe-accommodating opening has a radius greater than the radius R-1 of the opening 23. The difference in the radius and the reason therefore will be explained subsequently.

The front wall 7 of the pivoted section preferably has a window opening therein in which is mounted a transparent window pane 30. Between the window and the hinge 10 the front wall 7 of the pivoted housing section 3 is provided with a pair of access openings or inlets 31 each of which is fitted with an anchor ring 32 having at its inner end an annular groove 33. Secured to the inner end of each ring 32 is the open end of a sleeve 34, the opposite end of which terminates in an integral glove. The open end of the sleeve 34 overlies the groove 33 in the ring 32 and is removably secured therein by an elastic band 35 that is accommodated in the groove. The arrangement is such that a person may extend his hands and arms through the inlets 31 with his arms and hands covered by the sleeves and gloves, thereby enabling him to have access to the interior of the housing while the latter is closed.

The main section 2 of the housing terminates at its lower end in an oval-shaped neck 36 which defines an internal, downwardly open discharge outlet or throat 37. The neck 36 is encircled by an annular groove 38. A preferably transparent, plastic bag or pouch 39 has an open mouth at one end in which the neck 36 is accommodated. An elastic band 40 is fitted in the groove 38 and removably couples the pouch 39 to the neck 36.

Within the neck 36 is a pair of doors 41 each of which is pivoted at one side of the throat 37 by spring biased hinges 42 which act on the doors 41 in such manner as to urge the latter upwardly. Stops 43 overlie both doors 41 and limit their upward movement so that they normally assume a coplanar position which closes the throat 37. However, either or both the doors 41 may be displaced downwardly by a worker whose hands extend through the openings 31.

The end wall 6 is provided with a nipple 44 to which one end of a hose (not shown) may be coupled. The opposite end of such hose may be connected to a vacuum source. The end wall 6 also is provided with a coupling 45 to which a hose (not shown) may be connected. Attached to the coupling within the housing is a spray tube (not shown) through which water may be sprayed when desired.

The containment apparatus is adapted for use in stripping insulation from a pipe 46 (see FIG. 1). The pipe 46 is covered by insulation 47. The diameter of the insulation thus is greater than that of the bare pipe. The openings in the end walls of the housing are of such size as to enable a single housing 1 to be used in conjunction with pipes of greatly differing diameters. This characteristic may be enhanced by furnishing interchangeable arcuate straps 17 and 19 of different radial widths. Alternatively, the cuffs 22 at opposite ends of the housing may be of different radial thicknesses so that the areas of the openings at opposite ends of the housing are different. In any event, the openings are of different diameters so as to enable the seal 22 of the smaller diameter opening snugly to encircle the bare pipe 46, whereas the seal at the opposite end of the housing forms an opening of such size as snugly to accommodate the insulation 47.

To fit the housing 1 to the pipe 46, the latch members 12 are removed and the pivoted section 3 rocked about the hinge 10 so as to enable the pipe to be accommodated within the housing and extend through the openings at the opposite ends thereof. Thereafter, the hinged section 3 may be returned to the position shown in FIG. 2 and latched in position by the latch members 12. In these positions of the parts, the housing 1 will be supported entirely by the pipe, and the geometry of the housing is such that the housing is stable and occupies a position in which the neck 36 is lowermost and at a level below the pipe.

Prior to assembly of the housing 1 with the pipe the sleeves 34 will have been secured to the rings 32. Following assembly of the housing with the pipe, the pouch 39 may be secured to the neck 36 so as to be suspended from the latter.

A water delivery hose may be connected to the coupling 45 and the nipple 44 may be coupled to a vacuum source via an appropriate filter (not shown). Water may be sprayed upon that portion of the insulation within the housing 1 to soften the insulation and minimize the tendency of particles thereof to become airborne. The vacuum to which the interior of the housing 1 is subjected is sufficient to prevent the escape of air and airborne particles through any small gaps which may exist between the pipe 46 or the insulation 47 and the seals 22, and any gaps which may exist along the hinge 10 or between the seals 24 and 25.

Following assembly of the housing 1 with the pipe and the fitting of the vacuum source and water hose to the housing, a worker may thrust his arms and hands into the sleeves attached to the inlets 31 and, by use of appropriate tools (not shown), remove the insulation 47 from that portion of the pipe that is accommodated within the housing. Water that is not absorbed by the insulation, as well as the insulation removed from the pipe, will move downwardly by gravity and the removed insulation will lie upon the doors 41. At appropriate intervals the doors may be opened to allow the removed insulation to pass into the pouch 39.

The doors 41 perform the function of minimizing any tendency of the pouch to collapse as long as the doors are closed. The doors also serve to minimize the risk of a dropped tool's rupturing the wall of the pouch.

When all the insulation is removed from that part of the pipe which is accommodated in the housing, the housing may be moved longitudinally of the pipe so as to locate a fresh length of insulation within the housing. The removal of such insulation then proceeds in a manner like that described previously. During such movement of the housing it is not necessary to separate the sections 2 and 3.

If, during movement of the housing longitudinally of the pipe 46 a vertical support or other attachment on the pipe is encountered, one or more of the latches 12 may be removed and replaced in sequence as the housing is slid along the pipe. The gap between the confronting edges of the sections 2 and 3 is sufficient to accommodate the support and the deformability of the cuffs 22 and the seals 24 and 25 is sufficient to accommodate the support therebetween without the formation of an unduly large opening between the seals.

As has been indicated, insulation stripped from the pipe may be discharged downwardly through the throat 37, past the doors 41, and into the pouch 39. When the pouch has been filled to the desired level, it may be closed by being twisted, following which a retainer (not shown) may be applied to the twisted portion, the mouth removed from the neck 36, and the pouch disposed of in an appropriate manner. Thereafter, a fresh pouch may be applied to the housing and the insulation removal operation continued.

The disclosed embodiment is representative of a presently preferred form of the invention, but is intended to be illustrative rather than definitive thereof. The invention is defined in the claims.

We claim:

1. Containment apparatus comprising a form stable housing applicable to and movable along an elongate pipe having a layer of strippable material thereon, said housing having a length less than that of said pipe and terminating at opposite ends in end walls having openings therein through which said pipe may extend, said openings being in communication with one another via a continuous slot in said housing; an annular, resilient, deformable cuff carried by each of said end walls and being accommodated in the associated opening in position to confront and bear upon said pipe and the material thereon and form an occlusion between said material and said housing at said opening, at least one of said cuffs being of such thickness and deformability as to form an occlusion between its associated end wall and said pipe in the absence of said material on said pipe, each of said cuffs having a radial slit extending therethrough in register with that portion of said slot which is adjacent the associated opening; a pair of resilient and deformable seal members occupying said slot and separably abutting one another thereby enabling an attachment on said pipe to pass between said pair of seal members as said housing is moved along said pipe, said housing having at least one inlet therein between said end walls to which a sleeve may be attached in sealing relation to permit access to the interior of said housing while the latter is applied to said pipe and thereby enable said material between said end walls to be stripped from said pipe, said housing having a discharge outlet therein between said end walls; and means for securing to said housing a pouch in communication with the interior of said housing via said outlet.

2. Apparatus according to claim 1 wherein said openings have different areas.

3. Apparatus according to claim 1 wherein said housing is composed of two parts hinged to one another.

4. Apparatus according to claim 3 including releasable latch means for separably latching said two parts together.

5. Apparatus according to claim 1 including a window opening in said housing at one side thereof, and a transparent window pane occupying said window opening.

6. Apparatus according to claim 1 including a pair of door members within said housing adjacent said outlet, and hinge means mounting said door members on said housing to enable said door members to swing from a substantially horizontal position to a downwardly extending position.

7. Apparatus according to claim 6 wherein said hinge means include spring means for constantly biasing said door members to their horizontal position.

8. Apparatus according to claim 1 including a hose coupling carried by said housing for connection to a source of water.

9. Apparatus according to claim 1 including a nipple forming a passage into said housing for attachment to suction means.

10. Containment apparatus for use in stripping insulation from an elongate pipe, said apparatus comprising a form stable housing slideable along said pipe, said housing having a length less than that of said pipe and terminating at opposite ends in end walls each of which has an opening therein for the slideable accommodation of said pipe, said openings being in communication with one another via a continuous slot in said housing; a pair of resilient and deformable seal members occupying said slot and separably abutting one another thereby enabling an attachment on said pipe to pass through said slot between said pair of seal members as said housing is slid along said pipe, one of said openings having an area of such size as snugly to accommodate said pipe and the insulation thereon, the other of said openings having an area of such size as snugly to accommodate said pipe from which insulation has been stripped, said housing having at least one access opening between its ends through which a person's hand and arm may pass to enable insulation on said pipe between the ends of said housing to be stripped; means adjacent said access opening for securing one end of a sleeve adapted to accommodate such hand and arm, said housing having a discharge outlet in its bottom; and means carried by said housing adjacent said outlet for securing a pouch to said housing for the reception of material discharged through said outlet.

11. Apparatus according to claim 10 including deformable, resilient cuff means encircling each of said openings in said end walls and reducing the area of such opening.

12. Apparatus according to claim 10 wherein the openings at opposite ends of said housing are substantially uniform and the thickness of one of said seal means is greater than that of the other of said seal means.

13. Apparatus according to claim 10 wherein one of the openings at opposite ends of said housing is larger than the other and wherein the thickness of each of said seal means is substantially uniform.

14. Apparatus according to claim 10 wherein said housing is composed of two parts hinged to one another.

15. Apparatus according to claim 14 including releasable latch means for separably latching said two parts together.

16. Containment apparatus mounted upon an elongate pipe having strippable material thereon, said apparatus comprising a form stable housing movable longitudinally along said pipe, said housing having a length less than that of said pipe and having aligned openings therein at its opposite ends through which said pipe slideably extends, said openings being in communication with one another via a continuous slot in said housing; a pair of resilient and deformable seal members carried by said housing on opposite sides of said slot and normally abutting one another to seal said slot but enabling an attachment on said pipe to pass through said slot as said housing moves along said pipe, said housing having a discharge outlet between its ends; a resilient, annular, deformable cuff carried by said housing at each end thereof and accommodated in the associated opening in position to confront and bear upon said pipe and the material thereon and form an occlusion between said material and said housing at said opening, each of said cuffs having a radial slit extending therethrough in register with that portion of said slot which is adjacent the associated opening, said housing having at least one inlet therein between said ends to which a sleeve may be attached in sealing relation to permit access to the interior of said housing while the latter is mounted on said pipe and thereby enable said material between said ends to be stripped from said pipe, at least one of said cuffs being of such thickness and deformability as to form an occlusion between said housing and said pipe following the stripping of said material from said pipe; and means for separably securing to said housing a pouch in communication with the interior of said housing via said discharge outlet.

* * * * *